US005488891A

United States Patent [19]

Baker

[11] Patent Number: 5,488,891

[45] Date of Patent: Feb. 6, 1996

[54] SLIDE BAR FOR STRINGED MUSICAL INSTRUMENTS

[76] Inventor: Michael V. Baker, 4606 51A Street, Camrose, Alberta, Canada, T4V 1T3

[21] Appl. No.: 489,737

[22] Filed: Jun. 13, 1995

[51] Int. Cl.[6] ..... G10D 3/00

[52] U.S. Cl. ..... 84/319

[58] Field of Search ..... 84/318, 319

[56] References Cited

U.S. PATENT DOCUMENTS

| | | | |
|---|---|---|---|
| D. 360,647 | 7/1995 | Jimenez | D17/20 |
| 2,960,900 | 11/1960 | Fender | 84/290 |
| 3,822,629 | 7/1974 | Smith | 84/319 |

FOREIGN PATENT DOCUMENTS

| | | | |
|---|---|---|---|
| 241563 | 7/1924 | Canada . | |
| 346085 | 11/1934 | Canada . | |
| 797503 | 10/1968 | Canada | 84/37 |

*Primary Examiner*— Patrick J. Stanzione

[57] ABSTRACT

Slide bars for use with all types of musical instruments and in particular guitars played in either an overhand or an underhand style. One version of the slide bar consists of a tapered bar with a ring attached to the small diameter end of the bar. The slide is placed on a finger like a ring such that the slide can be engaged to contact the strings yet still permit use of all the fingers on the plucking hand. The slide can also be easily swung out of engagement with the strings and maintain the useability of the fingers on the plucking hand. The bar can be magnetic to reduce the need for players to develop exact pressure techniques. Another version of the slide consists of a hollow cylindrical tube in which magnetic or non-magnetic weight units are placed to emulate the same effect of solid tapered bars. Another version of the slide consists of a magnetized cylindrical tube that provides the advantages of controlling pressure on the strings similar to the magnetic tapered bar.

20 Claims, 4 Drawing Sheets

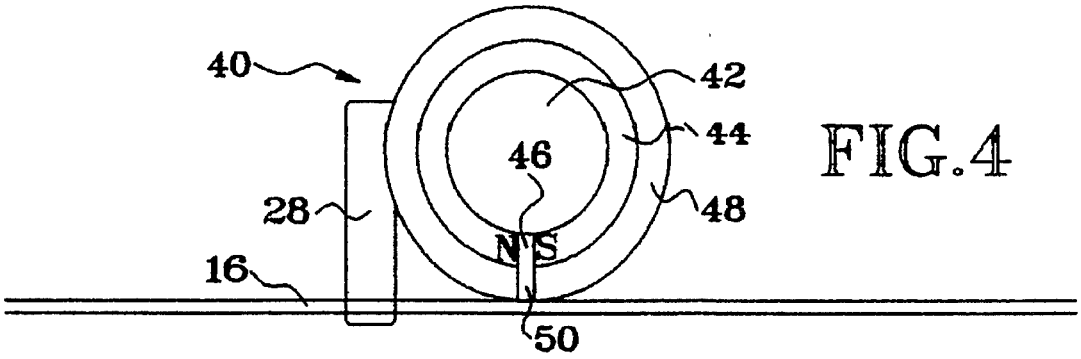
FIG.4
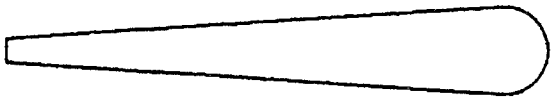
FIG.5C
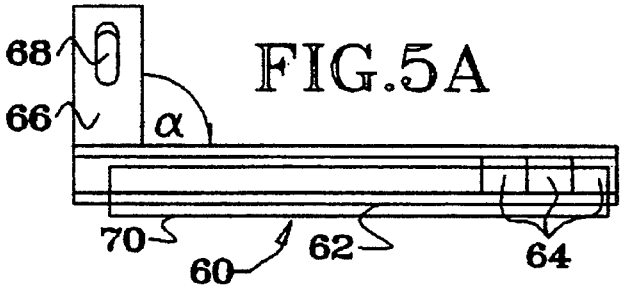
FIG.5A
FIG.5B
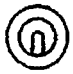
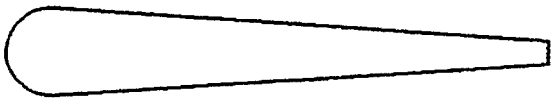
FIG.6C
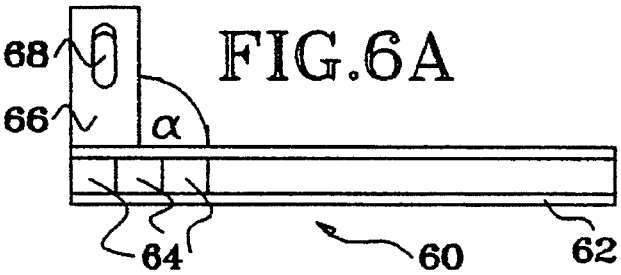
FIG.6A
FIG.6B
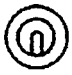
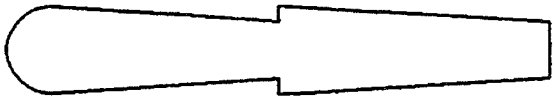
FIG.7C
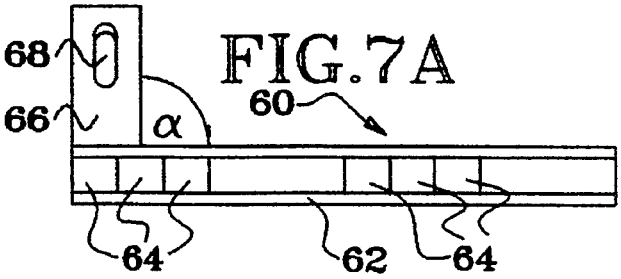
FIG.7A
FIG.7B
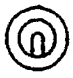

SLIDE BAR FOR STRINGED MUSICAL INSTRUMENTS

FIELD OF THE INVENTION

This invention relates to the field of slide bars for use with stringed musical instruments, and more specifically to slides for use on all types of guitars.

BACKGROUND OF THE INVENTION

A common guitar playing practice involves the use of a slide bar that is used to effectively change the critical contact point of the string set as the strings are vibrating to provide special sound characteristics.

Tube type slides are commonly employed that consist of a glass or metal tube that is placed over a finger. This effectively allows the player to play in the traditional underhand Spanish manner, but with only the remaining three fingers, since the tube prevents joint articulation. In view of this disadvantage, shorter tubes or rings have been proposed that permit a certain amount to freedom of movement of the finger on which they are fitted. However, these shortened tubes or rings tend to be too short to cover the entire width of the guitar neck, and an exacting pressure technique must be developed by the player to achieve the proper sustain with such a low mass in proximity to the string. Sustain is defined as the time of vibration of a plucked guitar string.

Canadian Patent Nos. 279,758 (issued Jul. 15, 1924 to Patterson), 406,415 (issued Nov. 20, 1934 to Carter), and 797,503 (issued Oct. 29, 1968 to Smith) teach various slide bars shaped to facilitate use on a Hawaiian type of guitar (for example, fretless lap steel guitars that are traditionally played in an overhand manner). These slide bars were made with considerable mass to facilitate sustain of a singularly plucked guitar string.

Carter and Smith also show that the slide bar can be attached to a ring. However, these devices were intended to be used in an overhead manner. In particular, Smith teaches the use of the slide on a "Mello-Bar" guitar that has no frets and is intended to be played in an overhead manner, whether the player is sitting or standing. It is virtually impossible to use these devices while playing in the traditional underhand Spanish fashion in a manner leaving others fingers free to fret notes in a traditional way. In fact, the Carter slide actually impedes more than one finger of the fretting hand, which is extremely undesirable.

Consequently, it would be desirable to provide a slide bar that remains unobtrusive to traditional Spanish or Classical playing styles; maintains the freedom and usability of all fingers of the fretting hand; and enables selective employment of the slide bar during slide passages. Further, it would be desirable to provide a slide that would reduce the need for the player to develop exact pressure skills.

SUMMARY OF THE INVENTION

An object of the present invention is to provide a slide bar that enables traditional guitar players to maintain freedom of movement of the fingers on their fretting hand while having one or more slide bars attached to their fretting hand.

Another object of the present invention is to provide a slide that reduces the need for stringed instrument players to learn difficult exact pressure skills required to play slide passages.

In accordance with one aspect of the invention there is provided a slide bar for use on strings of a musical instrument, comprising: a bar having a first and second end and an outer surface for sliding contact with the strings; and ring means connected at one end of the bar and being adapted to be positioned on a finger of a fretting hand such that the bar is operable between a first position in which the bar is in contact with strings and a second position in which the bar is in an elevated position above the strings, wherein in the first and second positions all fingers of the fretting hand are free to articulate and pluck the strings.

In accordance with another aspect of the present invention there is provided a slide for use on strings of a musical instrument, comprising: an elongate member adapted to transversely extend across all strings on the musical instrument; and means for magnetizing the member.

BRIEF DESCRIPTION OF THE DRAWINGS

Embodiments of the invention will be described by way of example in conjunction with the drawings in which:

FIG. 4 illustrates an end view of a magnetic slide bar according to another embodiment of the present invention;

FIGS. 5A/5B; 6A/6B; and 7A/7B illustrate side elevational and end views, respectively of cylindrical slides according to other embodiments of the present invention;

FIGS. 5C, 6C, and 7C are schematic representations of weight/magnetic effect of the slide bars of FIGS. 5A/5B; 6A/6B; and 7A/7B, respectively;

DETAILED DESCRIPTION OF EMBODIMENTS OF THE INVENTION

The slide bars of the present invention will be discussed primarily in conjunction with guitars. However, the slides of the present invention can also be used on other stringed instruments where the effect of modifying the critical contact points of the strings of the instrument during string vibration is desired.

Figure 1:
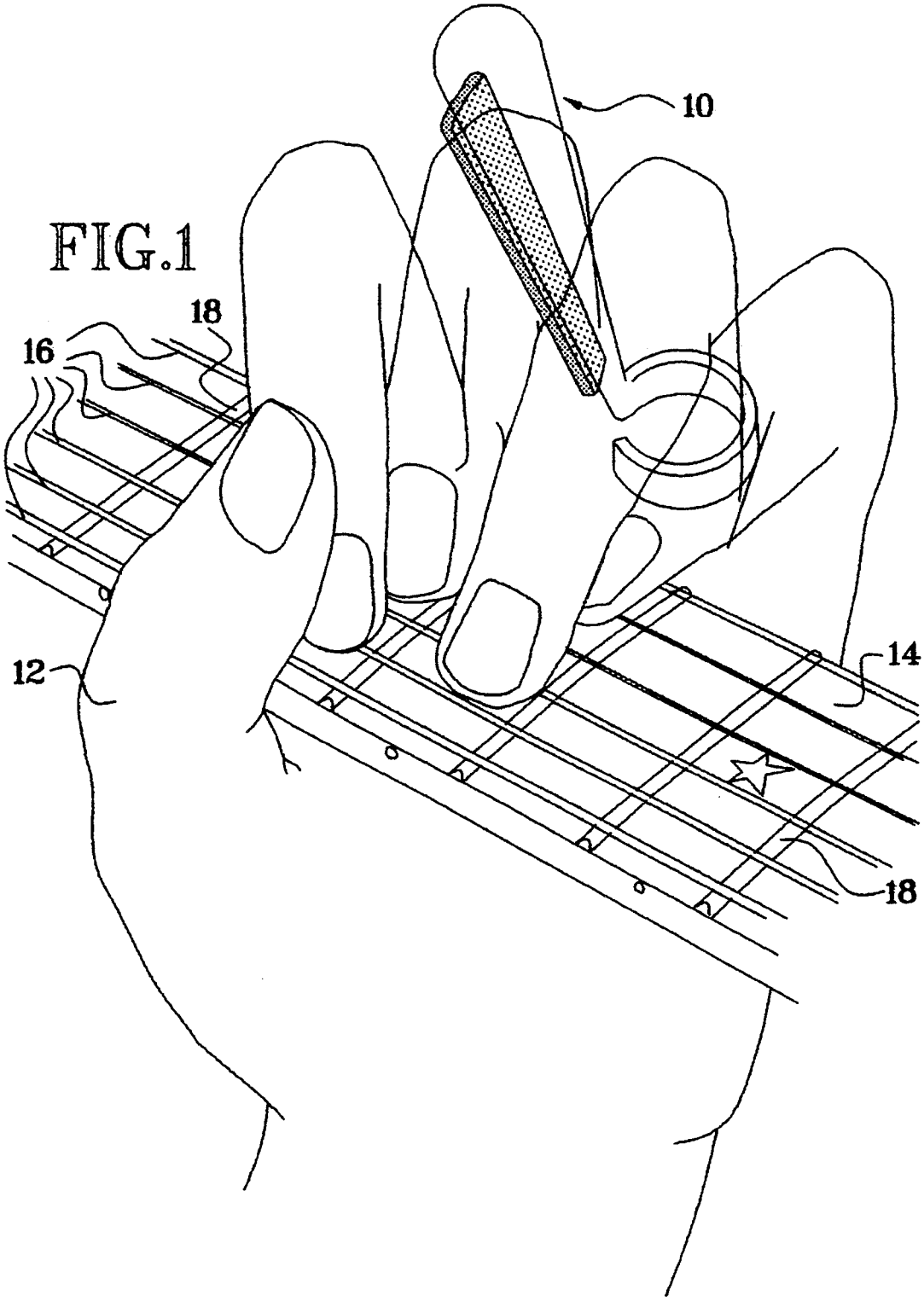
FIG. 1 illustrates a perspective view of a slide bar of the present invention in use.

FIG. 1 illustrates a slide 10 positioned on a fretting hand 12 curled around a neck 14 of a guitar having a plurality of strings 16 and frets 18. The slide 10 is shown in FIG. 1 in a standby position.

Figure 2A:
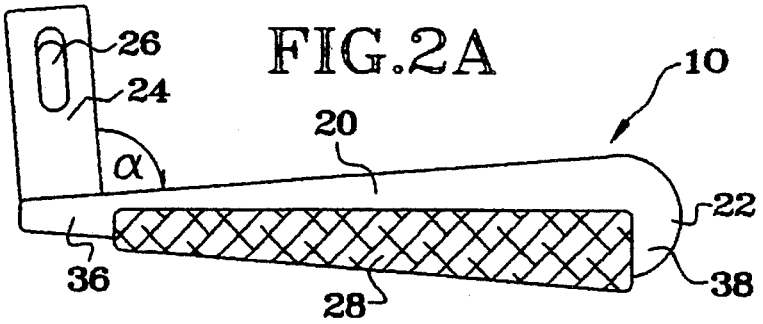
FIG. 2A illustrates a side elevational view of the slide bar of FIG. 1.
Figure 2B:
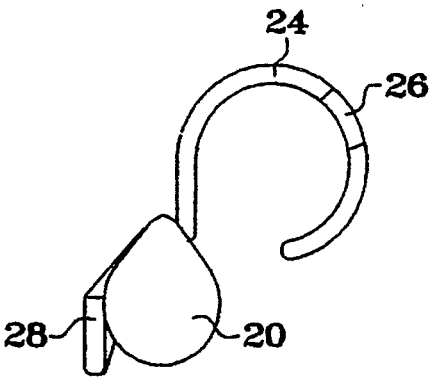
FIG. 2B illustrates a end view of the slide bar of FIG. 2A.

Referring to FIGS. 2A and 2B, the slide bar 10 includes a solid bar 20 made of steel, (for example, cold rolled steel (CRS)) that is tapered from a small diameter portion 36 to a large diameter portion 38. The large diameter portion 38 includes a hemispherical end region 22.

A ring 24 is attached to an end of the bar 20 at an angle α, which ranges from approximately 90° to 135° to provide flexibility for different users. It has been found that an angle of approximately 110° provides the best level of comfort and practicality. The ring 24 is not completely closed and includes a relief aperture 26 to allow for easy adjustment to accommodate different sized fingers.

A damping member 28 is attached along the side of the bar 20 to damp the vibration of the strings behind the slide 10 as the slide 10 is moved along the strings 16. This reduces sound that originates from both sides of the slide 10 that can cause undesirable distortion. The damping member 28 can be made from foam rubber or felt and can be attached to the bar using double sided tape, screws, bolts and the like.

In the embodiment of FIG. 2A, the ring 22 is located on the small diameter portion 36 of the tapered bar 20 so that the large diameter portion 38 (heavy end) will be positioned on the large diameter string (E note) and the small diameter portion 36 (light end) will be positioned on the small diameter string (high-E note). During traditional (i.e. classical spanish) slide passages it is preferable to have more weight bearing on the larger diameter strings for better response.

Figure 2C:
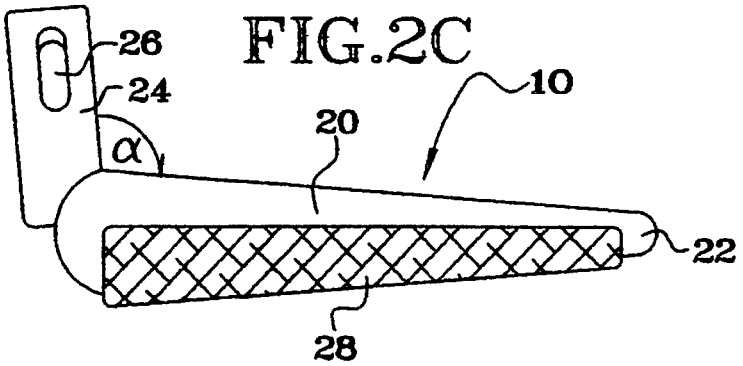
FIG. 2C illustrates a side elevational view of a slide bar according to another embodiment of the present invention.

FIG. 2C illustrates another embodiment in which the ring 24 is attached to the large diameter portion 38 of the bar 20. This will result in more mass being positioned over the small diameter strings resulting in an uneven response, which is desirable for certain players.

As shown in FIG. 1, the tapered bar 20 enables the slide 10 to fit easily between the player's fingers so that conventional fretting is not encumbered. The same benefits are realized using either the slide of FIG. 2A or FIG. 2C, although the slide of FIG. 2A will be preferred for players with small hands.

The slide 10 can be positioned, by twisting the ring 24 on the finger, between an elevated standby position (shown in FIG. 1) and a contact position whereby the bar 20 and damping member 28 are in contact with the strings 16 during slide passage play.

Figure 3A:
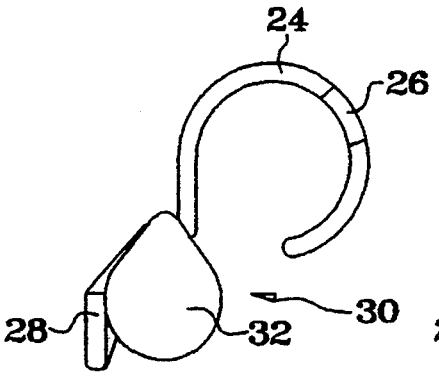
FIG. 3A illustrates an end view of a magnetic slide bar according to another embodiment of the present invention.

FIG. 3A illustrates a slide 30 that consists of a tapered magnetic bar 32 tapered in the same manner as bar 20 of FIG. 2C. The magnetic slide 30 attaches to the strings 16 to achieve essentially the same effect of large mass on large diameter strings to provide controlled downward pressure on the strings 16. This enables players to play slide passages without necessarily developing exact pressure skills.

In particular, it is common for novices to bottom out the strings 16 on the frets 18 of the guitar. The slide 30 reduces this tendency because the magnetic force provided by the bar 32 actually pulls the strings 16 away from the frets 18 making it more difficult to force the strings 16 to contact the frets 18 as the slide 30 is moved along the strings 16.

The ring 24 and damping member 28 operate in the same manner as discussed in conjunction with slide 10 illustrated in FIGS. 2A and 2B.

Figure 3B:
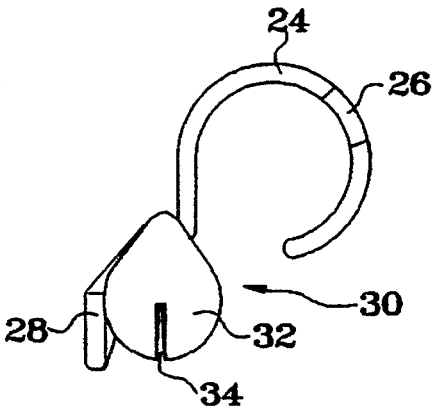
FIG. 3B illustrates an end view of a magnetic slide bar according to another embodiment of the present invention.

The magnetic slide 30 of FIG. 3B is essentially the same as the slide 30 of FIG. 3A, however, the slide 30 of FIG. 3B includes a recess 34 that extends longitudinally along the length of the bar 32 to concentrate magnetic force. The strings 16 are positioned transversely to the recess 34 during play. The recess 34 serves to further increase the weight effect of the bar 32. The weight effect is defined as the amount of magnetic force required to emulate the slide response of a non-magnetized weighted slide.

FIG. 4 illustrates a slide 40 according to another embodiment of the invention. The slide 40 consists of a solid or hollow core member 42. A cone shape magnetic 44 having a gap 46 is positioned around the core member 42 with the N-S magnetic polarities oriented at opposing sides of the gap 46. A cover 48 having a gap 50 and good magnetic permeability or conductivity (for example, CRS, or iron) is positioned around the magnetic 44 such that the gaps 46 and 50 are aligned with respect to each other and are located at or near a string contact position 52.

FIGS. 5A to 7C illustrate other embodiments of the present invention in which the same effect as using a tampered slide is achieved by providing a cylindrical tube containing various combinations of weights and magnets as discussed hereinbelow.

FIGS. 5A/5B illustrate a slide 60 that includes a cylindrical tube member 62. Cylindrical weight units 64 (either magnetized or non-magnetized) are inserted and friction fit into the tube member 62 to emulate the weight/magnetic characteristics of various tapered/shaped bars.

The slide bar 60 shown in FIGS. 5A/6A/7A each include a ring 66 having a relief aperture 68 for mounting on the players finger as detailed above in conjunction with FIGS. 2A and 2B. The ring 66 can be mounted at either end of the tube member 62 depending on the desired playing characteristics.

For example, FIGS. 5C/6C/7C illustrate the effect of loading the tube 62 with various weight units 64 as follows:

(a) FIG. 5A: three non-magnetized weight units 64 positioned at the end of the tube 62 opposite the end having the ring 66; this arrangement provides a same effect as slide bar 10 shown in FIG. 2A;

(b) FIG. 6A: three non-magnetized weight units 64 positioned at the end of the tube 62 having the ring 66; this arrangement provides a same effect as slide bar 10 shown in FIG. 2B; and (c) FIG. 6B: three non-magnetized weights units 64 positioned at the end of the tube 62 having the ring 66 and three magnetized weights units 64 positioned generally centrally within the tube 64; this arrangement provides a unique effect that would be difficult to manufacture as a solid construction.

Figure 8:
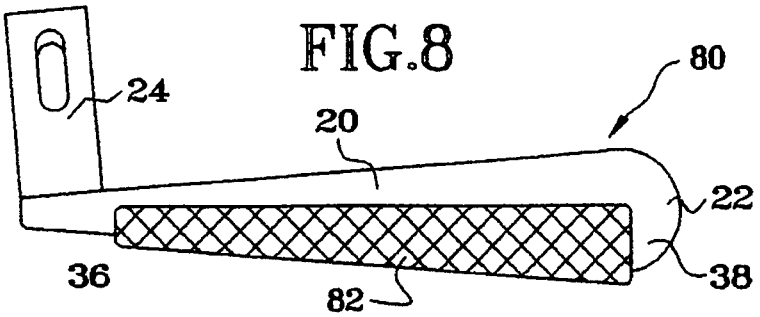
FIG. 8 illustrates a side elevational view of a slide bar according to another embodiment of the present invention.

FIG. 8 illustrates a slide bar 80 according to another embodiment of the invention. The slide 80 includes the tapered steel bar 20 and ring 24 as discussed in conjunction with FIG. 2A. A flexible magnetic damping member 82 made from aligned barium ferrite in a rubber matrix is attached to the side of the steel bar 80 to provide the duel advantage of a magnetic slide bar (such as slide bar 30 shown in FIG. 3A) and a non-magnetic damping member (such as damping member 28 shown in FIG. 2A).

Figure 9A:
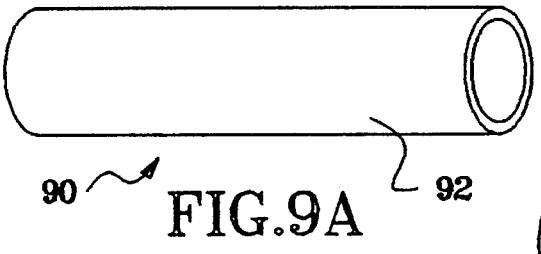
FIG. 9A illustrates a side elevational view of a slide tube according to another embodiment of the present invention.

FIG. 9A illustrates a slide 90 according to another embodiment of the invention. The slide 90 consists of a magnetic cylindrical tube 92 adapted to receive a finger on the fretting hand. The magnetic force provided by the tube 92 reduces the need for player's to perfect exact pressure skills as discussed in conjunction with the magnetic tapered slide bar 30 shown in FIG. 3A.

Figure 9B:
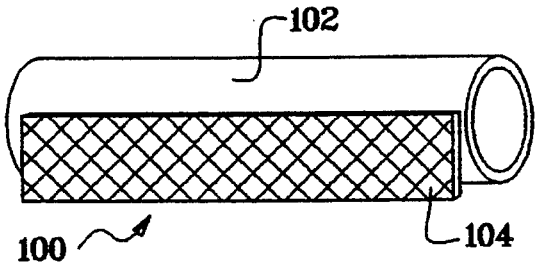
FIG. 9B illustrates a side elevational view of a slide tube according to another embodiment of the present invention.

FIG. 9B illustrates a slide 100 according to another embodiment of the invention. The slide 100 consists of a cylindrical tube 102 made from steel, plastic, glass, ceramic etc., and is adapted to receive a finger on the fretting hand. The tube 102 is magnetized (i.e. inherits magnetic properties) by attaching a magnetic member 104 to the side of the tube 102. The magnetic force provided by the member 104 reduces the need for player's to perfect exact pressure skills. The magnetic member 104 shown in FIG. 9B is flexible to function as a damping member as discussed in conjunction with the damping member 82 of FIG. 8.

Figure 10:
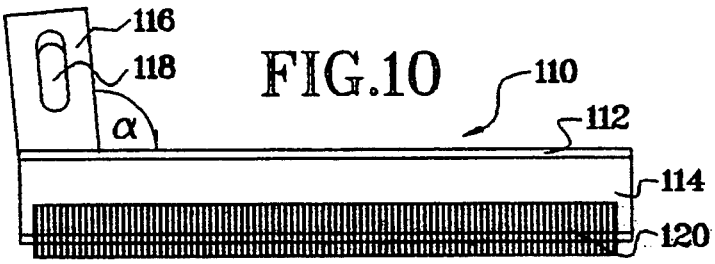
FIG. 10 illustrates a side elevational view of a slide bar according to another embodiment of the present invention.
Figure 11A:
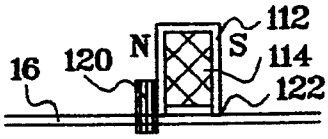
FIG. 11A illustrates an end view of the slide bar illustrated in FIG. 10.

FIGS. 10 and 11A illustrates a slide bar 110 according to another embodiment of the present invention. The slide 110 includes a rectangular U-shaped member 112 that receives a face poled magnet 114. The magnet 114 is positioned within member 112 to establish the N-S magnetic polarities on opposing sides of the member 112. A ring 116 having a relief aperture 118 is connected to the member 112 at an angle α, as discussed in conjunction with FIG. 2A.

A flexible brush damper 120 is connected to a side of the member 112 to reduce sound originating from both sides of the strings 16 as the slide 110 is moved along the strings 16.

One side of the member 112 includes an extended contact member 122. The contact member focuses the magnetic power from the magnet 114 to engage the strings 16 during slide passage play.

Figure 11B:
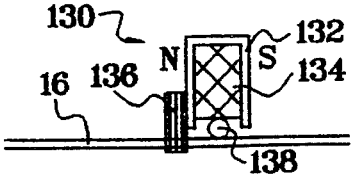
FIG. 11B illustrates an end view of a slide bar according to another embodiment of the present invention.

FIG. 11B illustrates a slide bar 130 having a member 132, magnet 134, and brush damper 136 as discussed for like elements in conjunction with FIG. 11A. The slide bar 130 includes an elongate cylindrical contact rod 138 that is attached to magnet 134. The rod 138 replaces the contact member 122 shown in FIG. 11A.

Figure 12:
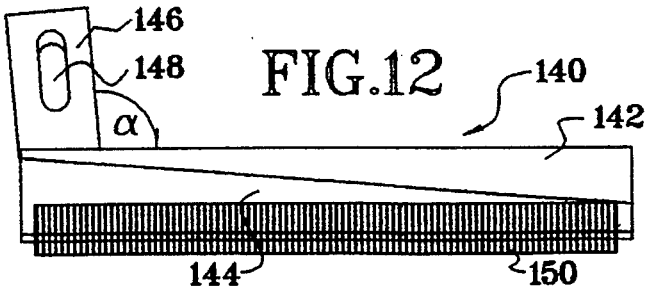
FIG. 12 illustrates a side elevational view of a slide bar according to another embodiment of the present invention.

FIG. 12 illustrates a slide bar 140 according to another embodiment of the present invention. The slide 140 includes a U-shaped member 142 that receives a tapered face poled magnet 144. The tapered magnetic 144 provides a variation of magnetic strength across the strings 16, as discussed in conjunction with FIGS. 5A, 6A, and 7A. The slide 140 includes a ring 146 having a relief aperture for easy size adjustment; and a brush damper 150 as discussed for like elements in conjunction with FIG. 10.

The various slide bars (10, 30, 40, 80, 110, 130, 140) of the present invention all have the advantage of being mountable on the fretting hand so as not to impede the use of the fingers.

The slide bar can easily be twisted on the finger for use during the play of slide passages, and twisted out of engagement of the strings during normal non-slide play.

The various tapers or taper effects (using cylindrical tubes 60 with weight inserts) function to provide the player with a wide variety of slide responses, which are dependent on the type of guitar, song, and player preferences.

The magnetized tube slides 90, and 100 of the present invention improve the ability of a player to play slide passages by reducing the tendency of bottoming out the strings on the frets of a stringed instrument.

I claim:

1. A slide bar for use on strings of a musical instrument, comprising:

a bar having a first and second end and an outer surface for sliding contact with the strings; and ring means connected at one end of the bar and being adapted to be positioned on a finger of a fretting hand such that the bar is operable between a first position in which the bar is in contact with strings and a second position in which the bar is in an elevated position above the strings, wherein in the first and second positions all fingers of the fretting hand are free to articulate and pluck the strings.

2. The slide bar of claim 1, wherein the bar is tapered from the first end to the second end.

3. The slide bar of claim 2, wherein one end of the tapered bar is hemispherical.

4. The slide bar of claim 2, wherein the ring means include a tab member formed in a generally circular arrangement.

5. The slide bar of claim 4, wherein the tab member is open on one side adjacent the bar and includes an aperture approximately at the mid-point of the tab member for size adjustment.

6. The slide bar of claim 5, wherein the ring means is attached to the first end of the bar.

7. The slide bar of claim 5, wherein the ring means is attached to the second end of the bar.

8. The slide bar of claim 1, further including damping means extending along the length of the bar.

9. The slide bar of claim 8, wherein the damping means is constructed of a material selected from the group consisting of foam rubber and felt.

10. The slide bar of claim 8, wherein the damping means is magnetic.

11. The slide bar of claim 1, wherein the bar is magnetic.

12. The slide bar of claim 8, wherein the bar includes a longitudinal recess extending along the length of the bar.

13. The slide bar of claim 1, wherein the bar includes:

a hollow core member;

a cone magnetic surrounding the core member, said cone magnetic having a gap region with N-S magnetic polarities being oriented at opposing sides of the gap region;

a cover surrounding the cone magnetic, said cover having a gap region aligned with the gap region of the cone magnetic, wherein said gap regions are adapted to transversely contact the strings when the bar is in the first position.

14. The slide bar of claim 1, wherein the bar includes:

a hollow cylindrical tube member; and weight units slidably engagable within the tube member.

15. The slide of claim 14, wherein the weight units are magnetic.

16. The slide of claim 1, wherein the bar includes:

an elongate member having a longitudinally extending channel; and a magnet positioned within the channel of the member with N-S magnetic polarities being oriented at opposing sides of the member.

17. The slide of claim 16, wherein the elongate member includes an contact extension member located along one side of the member for making contact with the strings of the musical instrument.

18. The slide of claim 16, further including an elongate contact member positioned longitudinally along the magnet to transversely extend across the strings of the musical instrument.

19. A slide for use on strings of a musical instrument, comprising:

an elongate member adapted to transversely extend across all strings on the musical instrument; and means for magnetizing the member.

20. The slide of claim 19, wherein the elongate member is a cylindrical tube, and the means of magnetizing includes a magnetic damping member attached along the longitudinal length of the cylindrical tube.

* * * * *